US007825601B2

(12) United States Patent
Morehouse

(10) Patent No.: US 7,825,601 B2
(45) Date of Patent: Nov. 2, 2010

(54) AXIAL HALL ACCELERATOR WITH SOLENOID FIELD

(76) Inventor: Mark Edward Morehouse, 2408 Carlton Pl., Costa Mesa, CA (US) 92627

( * ) Notice: Subject to any disclaimer, the term of this patent is extended or adjusted under 35 U.S.C. 154(b) by 407 days.

(21) Appl. No.: 11/998,083

(22) Filed: Nov. 28, 2007

(65) Prior Publication Data

US 2009/0134804 A1 May 28, 2009

(51) Int. Cl.
*H05B 31/26* (2006.01)

(52) U.S. Cl. ..... 315/111.81; 315/111.91; 315/111.61

(58) Field of Classification Search ..... 315/500, 315/501, 505, 506, 507, 84.51, 84.61, 111.21, 315/111.31, 111.41, 111.51, 111.61, 111.81, 315/111.91; 313/359.1, 360.1, 362.1, 363.1, 313/545

See application file for complete search history.

(56) References Cited

U.S. PATENT DOCUMENTS

| | | | | |
|---|---|---|---|---|
| 2,672,560 | A | 3/1954 | Berry | |
| 2,847,607 | A | 8/1958 | Pierce | |
| 3,243,954 | A | 4/1966 | Cann | |
| 3,309,873 | A | 3/1967 | Cann | |
| 3,388,291 | A | 6/1968 | Cann | |
| 3,628,342 | A | 12/1971 | Becker | |
| 4,065,351 | A | 12/1977 | Jassby | |
| 4,267,488 | A | 5/1981 | Wells | |
| 4,293,794 | A | 10/1981 | Kapetanakos | |
| 4,788,024 | A | 11/1988 | Maglich | |
| 5,973,447 | A | 10/1999 | Mahoney | |
| 6,086,962 | A | 7/2000 | Mahoney | |
| 6,448,721 | B2 | 9/2002 | Raitses | |
| 6,523,338 | B1 | 2/2003 | Kornfeld | |
| 6,593,539 | B1 * | 7/2003 | Miley et al. | 219/121.36 |
| 6,777,699 | B1 * | 8/2004 | Miley et al. | 250/492.3 |
| 6,777,862 | B2 | 8/2004 | Fisch | |
| 7,075,095 | B2 | 7/2006 | Kornfeld | |
| 2002/0163289 | A1 | 11/2002 | Kaufman | |
| 2005/0172885 | A1 * | 8/2005 | Boettcher et al. | 116/208 |

OTHER PUBLICATIONS

Zubkov, Kislov and Morozov, Optimization of a High Current Ion Accelerator, Soviet Physics, vol. 17, No. 4, Oct. 1972.
Zubkov, Kislov and Morozov, Experimental Study of a Two-Lens Accelerator, Soviet Physics, vol. 15, No. 11, May 1971.
H.C. Cole, A High Current Hall Accelerator, Nuclear Fusion, 10, 1970.

* cited by examiner

*Primary Examiner*—Douglas W Owens
*Assistant Examiner*—Jianzi Chen

(57) ABSTRACT

The present patent letters discloses a Hall Current accelerator with a solenoid Hall field, a collimated gas source, an anode, intermediate Hall effect ionization magnetic field structures and intermediate acceleration electrodes. The Hall field in this case is the end fringe field(s) of a common solenoid magnetic field.

25 Claims, 3 Drawing Sheets

AXIAL HALL ACCELERATOR WITH SOLENOID FIELD

BACKGROUND OF THE INVENTION

1. Field of the Invention

The present invention is directed generally to a closed drift Hall type accelerator in a vacuum space.

2. Description of Related Art

The present invention attempts to achieve a high energy ion beam source which is superior to existing accelerators in beam density and energy. Hall Current accelerators operate without space charge limitations as are present in conventional ion beam accelerators, which use electrostatic lens (grids) to extract ions from a neutral plasma (gridded ion sources). Such devices can have very good optics. That is they can have a very well defined velocity vector and energy spread.

In Hall accelerators ion acceleration is achieved by providing a voltage potential between an anode associated with a neutral gas source and a cathode in the general vicinity of the beam exit. Electrons from the cathode migrate through the Hall effect fields, which pick up the electrons in E×B azimuthal orbits, restraining their axial transit. This allows electrons to accumulate in the Hall magnetic fields. The neutral gas from the anode structure encounters the counter-streaming electrons and becomes electron impact ionized, thereby forming ions that are accelerated by the electric field between the anode and the cathode. The ions are never separated from the electrons as in electrostatic extraction. An accelerating electric gradient is established between a virtual cathode formed by the electrons captured in Hall effect orbits and the anode. Closed drift Hall effect accelerators are generally defined as having ion gyro-radii much greater than the acceleration channel width and electron gyro-radii generally somewhat less than the channel width. Thus the ions go through minor azimuthal deviation in the acceleration Hall effect field. Most Hall effect devices have been of the single stage type, where the neutral gas is introduced into the ionization and acceleration region from within the Hall effect magnetic field structure. Therefore the ions are accelerated only through the exit fringe field of the solenoid. Transport through the fringe (radial component of the solenoid field) generally imparts azimuthal momentum to the ions. Two stage accelerators have been studied in an attempt to reduce the divergence of the beam because the azimuthal thrust imparted to the ions in the first fringe field is countered by the second fringe field which is in the opposite direction and therefore imparts opposite azimuthal thrust to the ions. Two stage accelerators contain inner and outer pole pieces that generate the two alternately directed radial fringe fields.

To inject ions into the end of a solenoid, they must be transported across the fringe magnetic field. Axial ion injection has been most frequently attempted by means of magnetically insulated pulsed type ion diodes. The ions generated by such devices are then typically transported across a full cusp, not a half cusp (fringe) field. A full cusp exists between two oppositely aligned solenoids. Ion transport across a full cusp results in large canonical angular momentum orbits that do not approach the magnetic field axis but rather encircle the axis. The prior art ion injection methods are limited by issues of ion trapping as well as space charge neutralization. Generally trapping schemes involve fast magnetic field ramping or a change in the charge to mass ratio by molecular disassociation. Prior art methods for space charge neutralization typically involve the pre-introduction of background plasma because electrons are stripped from the beam as the ions transport across the field.

The present invention is distinguished from previous methods of cross field transport into a solenoid field in that the present invention actively accelerates ions across the fringe field, utilizing the fringe field itself as a Hall effect ion acceleration field. Because the accelerator operates on the Hall effect principle electrons are present everywhere, mitigating space charge issues, both in the fringe and in the solenoid. Additionally, since the ions are accelerated into the field they will be decelerated if they attempt to escape, and ideally returned by the initial process. Hall acceleration occurs across the fringe field. When the electron source cathode is located outside of the solenoid, beyond the distal (exit) fringe, then both fringe fields serve as Hall effect fields and the ions are accelerated out of the distal end of the solenoid. The azimuthal momentum imparted by the first (entrance) fringe field is countered by the second (exit) fringe field, returning the original axial trajectory to the ions. The ions will have gained energy by acceleration across both fields.

The present invention reveals one or more electron sources positioned at any desirable location around or within the solenoid magnetic field. The electron sources neutralize ion space charge, from the time of ion formation from neutral gas throughout the acceleration and storage process.

The present invention is further distinguished from the prior art in that the ion gyro-radii may be generally equal to the axial length of the acceleration channel. The ions are made to undergo a generally 90 degree angle as they pass through the Hall effect field. The initial axial trajectory is bent into azimuthal during the entrance acceleration process. Within the solenoid the ion orbit should have very low canonical angular momentum. An ion with low canonical angular momentum, passes close to or crosses the magnetic field axis. This much greater ion bending is made possible because the inner pole piece has been removed and the ions are free to gyro-rotate too the axis of the magnetic field once they have entered the solenoid.

In a present embodiment the ions should have low, desirably zero, values of canonical angular momentum. An ion that transports across one end fringe of a solenoid can have zero canonical angular momentum if the ion was originally traveling parallel to the magnetic field axis. Zero canonical angular momentum orbits are characterized by having contact with the magnetic field axis once each orbit. The apparatus is preferably designed such that the ions exit the solenoid at a point in the solenoid where the ions are on axis. Zero canonical angular momentum ions will exit the solenoid with maximum axial momentum, and minimum radial momentum. Thus a well collimated beam emerges and the initial annular distribution of ions is combined into a small cross section central axis ion beam. Hall Current accelerators are of annular design because of the need for radial magnetic field lines to restrain the electrons in closed drift Hall Current orbits capable of producing the accelerating electric field gradient. The Hall effect electrons also provide ionization to the neutral gas.

The present invention is further distinguished from the prior art in that an annular gas valve is implemented such that the gas entering the radial Hall effect fringe magnetic field is a cylindrical sheath of collimated neutral gas, thereby minimizing any non-axial momentum particles. Neutral gas particles encounter the radial Hall effect field traveling parallel to the axis but not on axis, as is required for a Hall accelerator. The annular well collimated axial neutral gas sheath is formed into a stream of spiraling ions in the solenoid.

The present invention is further distinguished from the prior art by its ability to combine the annular geometry Hall effect beam into a single central beam in the exit fringe field. This is possible because there is no inner pole piece. The beam collimation is determined by the collimation of injected neutral gas.

The following references illustrate the prior art with regard to Hall Current accelerators. Raitses et.al. U.S. Pat. No. 6,448,721 reveals an example of the progression of Hall accelerators from the common annular design towards a reduction of the inner electrode with their cylindrical geometry Hall accelerator, the design references a single stage Hall accelerator. Fisch et.al U.S. Pat. No. 6,777,862 discloses a segmented electrode Hall thruster with reduced plume, addressing the importance of reducing plume divergence. Mahoney et.al. U.S. Pat. Nos. 5,973,447 and 6,086,962 discloses a gridless Hall effect ion source for the vacuum processing of materials. I. P. Zubkov et.al. in OPTIMIZATION OF A HIGH CURRENT ION ACCELERATOR, Soviet Physics—Technical Physics, Vol. 17, No. 2 October 1972, reveals how a two stage Hall accelerator has an appreciably reduced angular beam divergence. Kornfeld et.al. in U.S. Pat. Nos. 6,523,338 and 7,075,095 discloses plasma accelerators using multi-acceleration stages. Cann U.S. Pat. Nos. 3,309,873 and 3,243,954 discloses a plasma accelerator utilizing a Laval type nozzle and Cann U.S. Pat. No. 3,388,291 discloses an annular array of multiple collimating Anode gas sources, but not an annular structure. Kapetanakos U.S. Pat. No. 4,293,794 reveals a method of pulsed full cusp cross field transport of ions into a solenoid field, with a half cusp beam exit. Maglich U.S. Pat. No. 4,788,024 reveals a high energy, low current injection that attempts to achieve zero canonical angular momentum orbits. J. R. Pierce U.S. Pat. No. 2,847,607 discloses a beam focusing apparatus. Erwin Becker U.S. Pat. No. 3,628,342 reveals a method for fluid gas separation utilizing an annular nozzle. Kaufman et. al. US2002/0163289 A1 discloses a single stage Hall effect accelerator. C. E. Berry U.S. Pat. No. 2,672,560 reveals an annular ionization chamber. Jassby et. al. reveals a particle beam injection system. Wells U.S. Pat. No. 4,267,488 discloses a system for forming and compressing plasma in axis encircling ringlike toroidal plasma vortex structures. H. C. cole in A HIGH CURRENT HALL ACCELERATOR, Nuclear Fusion, 10, 1970 reveals a high current two stage Hall accelerator. I. P. Zubkov in EXPERIMENTAL STUDY OF A TWO-LENS ACCELERATOR, Soviet Physics—Technical Physics, Vol. 15, No. 11, May 1971 discloses a high current closed drift Hall accelerator.

BRIEF SUMMARY OF THE INVENTION

In general, the invention is directed toward an ion accelerator comprising a collimating gas source and an anode external of a solenoid for producing a magnetic field and an electron source cathode beyond the proximal (entrance) fringe, contained in a vacuum space. An embodiment has a proximal entrance end with an annular vacuum gap adapted for a fringe radial magnetic field in the vicinity of the annular vacuum gap. The annular collimating gas source is adapted for directing gas past an anode electron extraction apparatus associated with a source of electric power. The collimated gas is directed into the annular vacuum gap wherein a fringe radial magnetic field forms a Hall effect field in conjunction with an anode and a cathode electron source. An annular ion beam is formed from the neutral gas by electron impact ionization. The ion beam is accelerated into the solenoid by the electric field established between the anode and the cathode.

In an embodiment ions exit the distal end of the solenoid through the distal exit end fringe field. Since the ions are accelerated by a Hall Effect Current, space charge issues are mitigated by the Hall effect electrons. The ions exit at a radius and with a collimation that is length and phase coherent dependent. In an embodiment the electron source is internal to the solenoid and the ions are injected into the solenoid for storage and accumulation.

Intermediate collimating gas throats may be introduced between the gas source and the entrance fringe field.

Intermediate pre-ionization Hall fields of generally lower magnetic field, may be implemented between the Solenoid proximal entrance fringe and the gas source. Intermediate Hall effect fields may be created by a pair of permanent magnets or by sets of coil windings producing a generally radial magnetic field across the annular cylinder defined by the gas sheath. Where permanent magnets are implemented they would have opposite (attractive) radial fields facing one another. Where electromagnet coils are implemented they incorporate radial pairs that carry currents such that a generally and predominantly radial magnetic field is present between the coil pairs in the general vicinity of the gas sheath channel produced by the collimation nozzles. Typically such magnetic field structures incorporate hi-mu yoke structures.

Intermediate electrodes may also be implemented in the vacuum space between the cathode and the Anode. They may be associated with said intermediate Hall field magnets or they may be associated with the collimation throats or separate from either or both, either running along the inner aspect of the gas sheath or on the outer aspect or a combination of the two.

An electrical bias placed between a pair of intermediate electrodes implemented on opposite sides of the gas sheath and in conjunction with an intermediate magnet Hall effect field, can serve to separate the Anode from the gas source by sweeping the electrons out of the channel prior to encountering the gas source. This novel composition of elements makes possible the separation of the Anode and the neutral gas source structure. Thereby protecting the gas source structure from bombardment by the counter-streaming Hall effect electron current. This useful feature is herein referred to as a gas free anode.

Because the gas provided to the accelerator is collimated and therefore restrained in its trajectory to only the channel of acceleration the intermediate Hall field and acceleration electrodes may be suspended in the free space within the vacuum vessel. This is not possible in a typical Hall effect accelerator where the coaxial channel must direct the gas flow which in the prior art is not collimated and therefore is traveling generally in many directions.

Characteristics of the ion orbits and trajectories are established by the following system parameters:

The neutral gas dynamics established by the nozzle characteristics.

The radial dimension of the solenoid.

The axial dimensions of the solenoid and the Hall accelerator section.

The acceleration voltage.

The solenoid magnetic field strength.

The Hall accelerator cathode electron source characteristics.

DETAILED DESCRIPTION OF THE INVENTION

Figure 1:
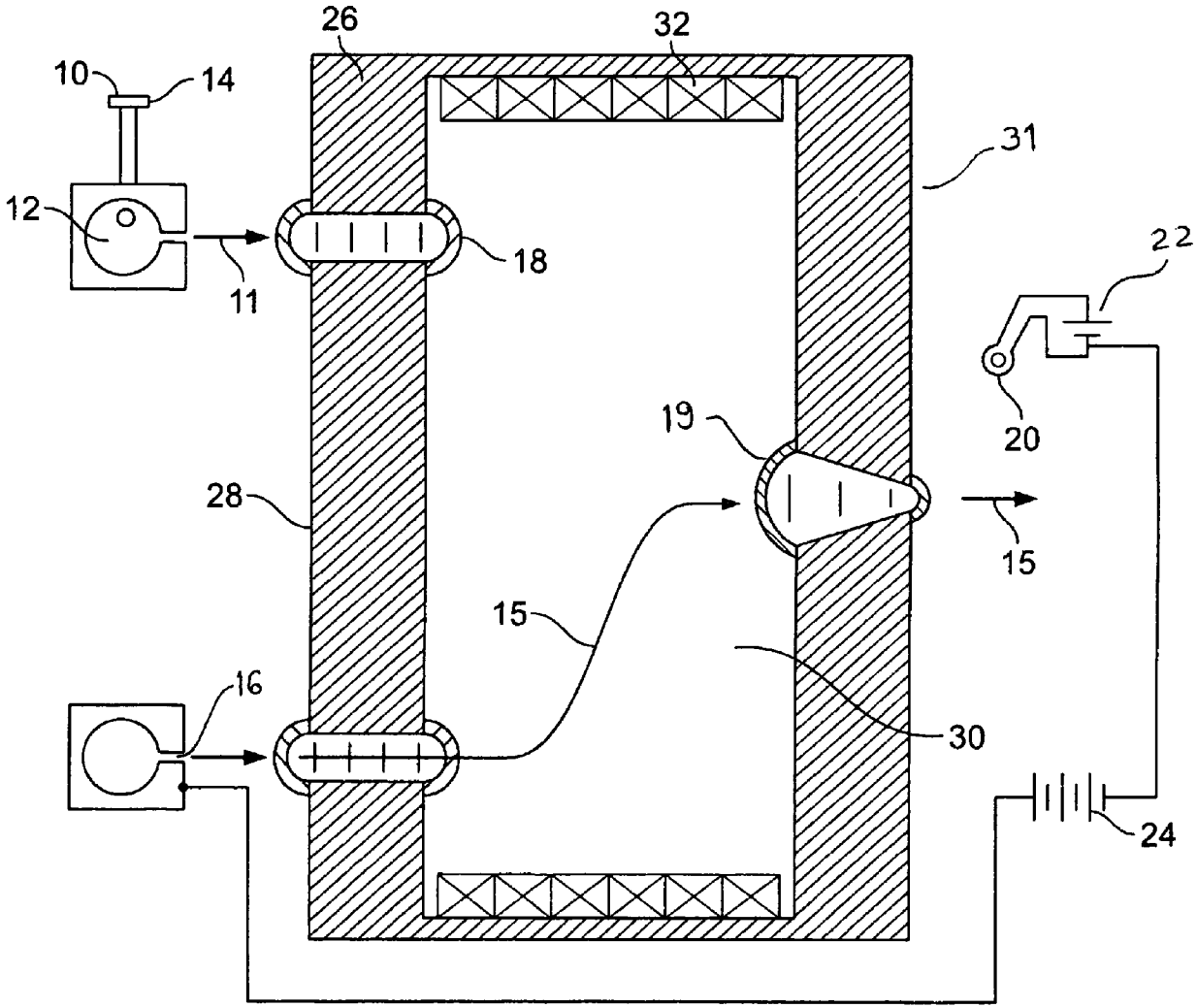
FIG. 1 is a side perspective cross sectional view of an embodiment of the invention where the gas source is also the Anode.

FIG. 1 reveals a first embodiment of the present invention. Gas 10 is introduced into a plenum 12 through a gas input port 14. The gas 10 expands supersonically through an annular Laval type nozzle 16 forming an annular gas sheath 11 traveling through a vacuum on axis with a solenoid 31. Gas sheath 11 is ionized by electrons that transit through the Hall fields 19 and 18 from electron source 20 and 22 under the influence of acceleration power supply 24. The ions 15 are accelerated through the two Hall effect radial fringe fields 18 and 19 by the acceleration power supply 24. The first of two Hall fringe fields, entrance fringe field 18, is established between a return flux iron core 26 and a fringe core 28. Within the entrance fringe field 18 the ions' 15 original axial trajectory is bent as the ions are accelerated into energetic azimuthal orbits which then spiral though the solenoid field 30 maintained by solenoid windings 32. The axial extent of the solenoid is such that the ions are on axis when they reach the distal end of the solenoid and exit through the second of two radial fringe fields, exit fringe field 19. The exit fringe field 19 re-converts the azimuthal ion momentum back into axial momentum during a second acceleration process. The ions 15 then transit through the electron cloud established by the electron source power supply 22 and electron source cathode 20.

Figure 2:
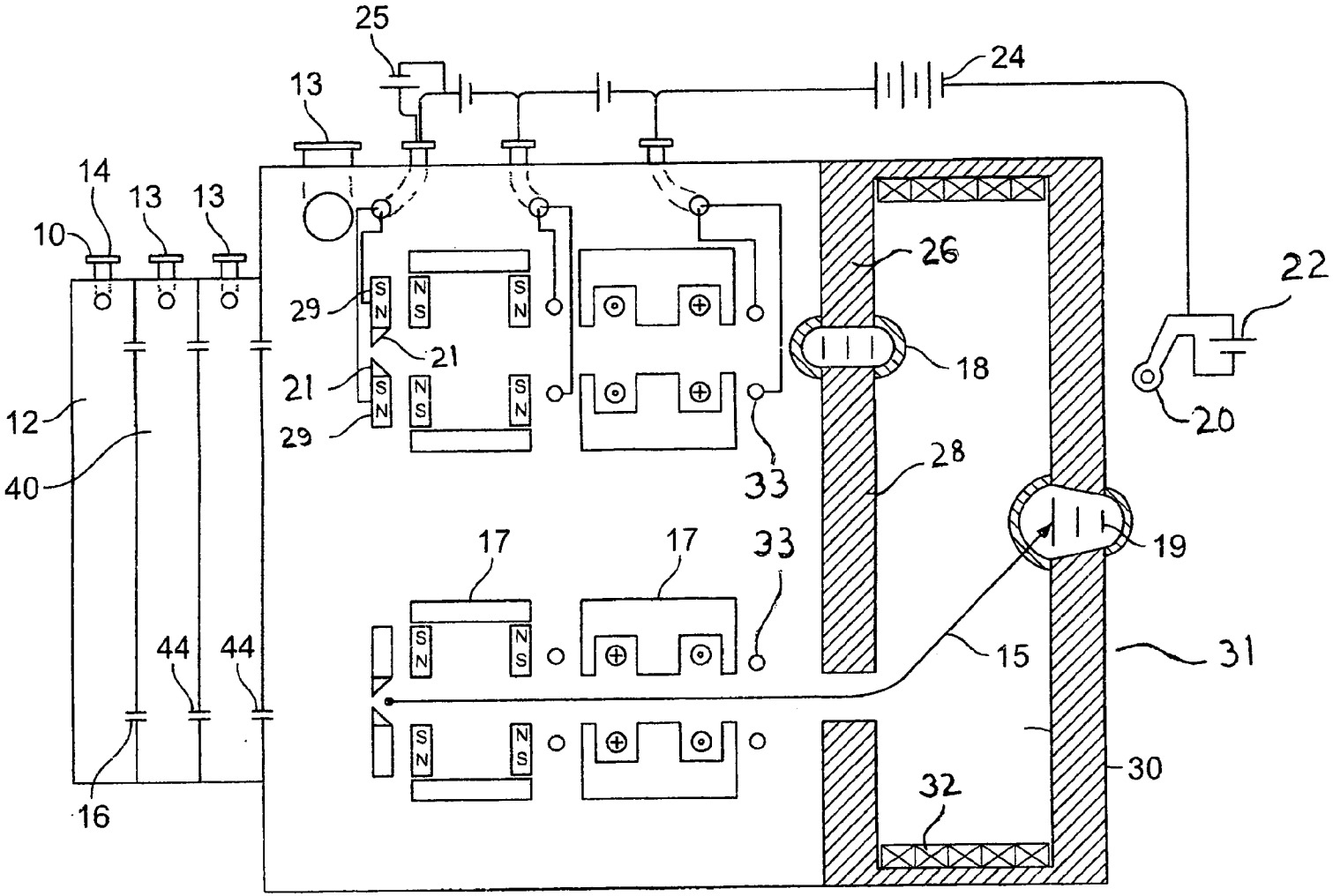
FIG. 2 is a cross sectional view of another embodiment of the invention having an anode isolated from the gas source, intermediate collimating throats, intermediate Hall effect magnetic field structures and intermediate electrodes.

FIG. 2 reveals a second embodiment of the present invention. Gas 10 is introduced into Gas plenum 12 through gas input port 14 which expands supersonically through a directional annular convergent-divergent type nozzle 16 into a differential pumping chamber(s) 40, with vacuum pumping port(s) 13, where neutral gas atoms that are not traveling on axis are stripped away by a second, or more, collimating gas throats 44, resulting in a higher degree of axial collimation of the streaming gas. The anode structure is comprised of a pair of electrodes 21 and a bias power supply 25, which provides a voltage potential between the two electrodes 21. Electrodes 21 are on common Hall effect magnetic field lines established by Hall effect magnetic field structures 29 or 26 and 28. Intermediate magnetic field structures allow the electrode bias supply 25 to divert electrons to the more positive of the two electrodes 21 which then forms the anode of the acceleration power supply 24. The gas source 16 or 44 may alternatively serve as the anode, where electron bombardment can be tolerated. Electrons counter-streaming from the cathode 20 towards the anode 21, 44 or 16 are restrained in their transit through fringe fields 19 and 18 as well as intermediate Hall effect field sources 17. Intermediate acceleration electrodes 33 may be implemented in the space between the anode and the cathode. The Hall effect electrons ionize the neutral gas 10. The resultant ions 15 are accelerated through the solenoid 31 produced by solenoid field windings 32 and then space charge neutralized by cathode electron source 20.

Figure 3:
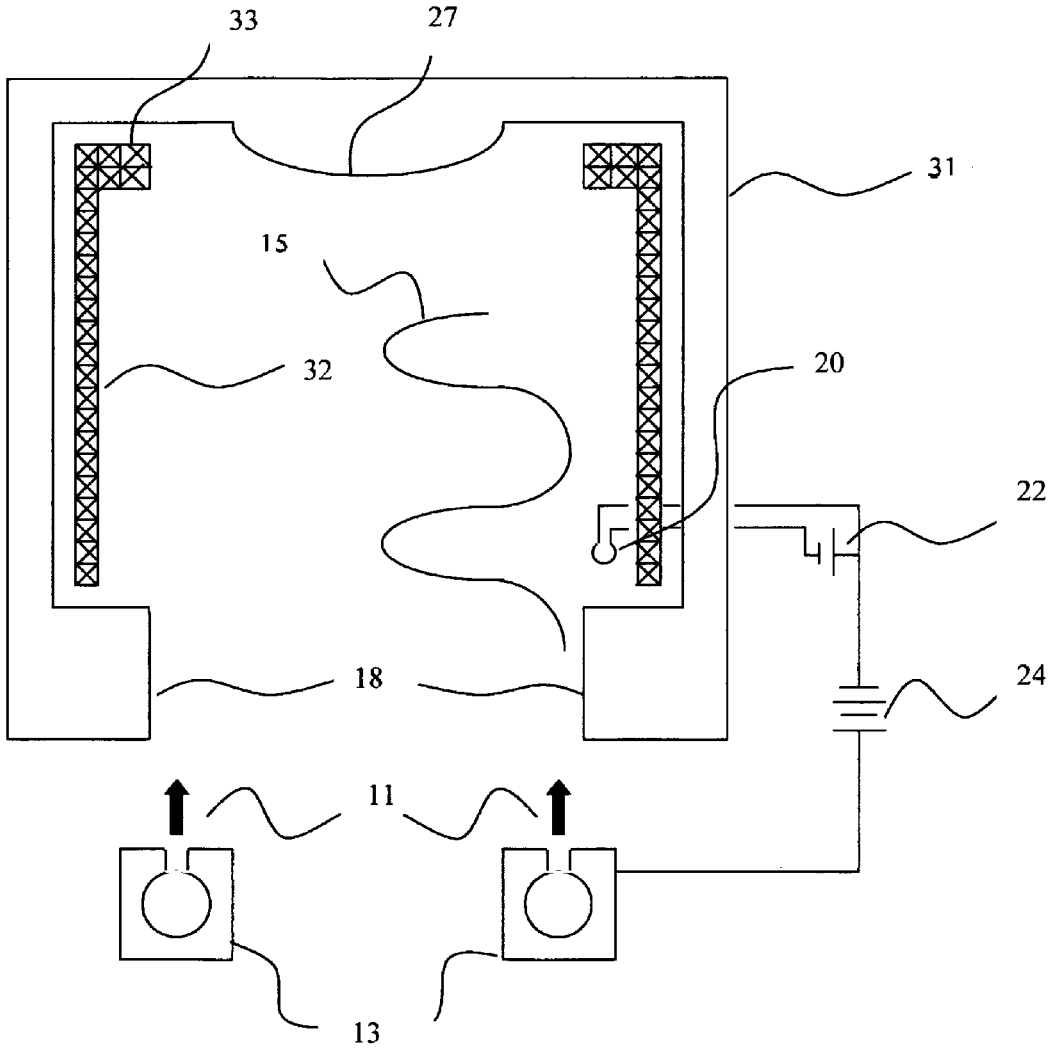
FIG. 3 reveals an embodiment of the device having one of more electron source(s) 20 and 22, associated with solenoid 31. Neutral gas sheath 11 from gas collimating anode 13 is ionized and accelerated across entrance fringe field pole pieces 18, by power supply 24. Solenoid 31, having mirror coils 33 and mirror field iron pole face 27 reflect ions 15.

FIG. 3 reveals an embodiment of the device having one of more electron source(s) 20 and 22, associated with solenoid 31. Neutral gas sheath 11 from gas collimating anode 13 is ionized and accelerated across entrance fringe field pole pieces 18, by power supply 24. Solenoid 31, having mirror coils 33 and mirror field iron pole face 27 reflect ions 15.

There has thus been described a novel closed drift Hall type accelerator. It is important to note that many configurations can be constructed from the ideas presented. The foregoing disclosure and description of the invention is illustrative and explanatory thereof and thus, nothing in the specification should be imported to limit the scope of the claims. Also, the scope of the invention is not intended to be limited to those embodiments described and includes equivalents thereto. It would be recognized by one skilled in the art the following claims would encompass a number of embodiments of the invention disclosed and claimed herein.

I claim:

1. An ion accelerator comprising:

an annular collimating gas source;

an anode;

a solenoid for producing a magnetic field and having a proximal entrance end, the proximal entrance end having a fringe magnetic field;

one or more cathode electron source(s) positioned within the solenoid magnetic field;

the annular collimating gas source directing gas axially into the entrance end fringe magnetic field in conjunction with the anode and cathode producing an annular ion beam; and the ion beam being accelerated by an electric field between the anode and the cathode into the solenoid through the entrance end fringe magnetic field; and the ion beam being space charge neutralized by the cathode electron source.

2. The ion accelerator of claim 1 wherein the anode is associated with the annular collimating gas source.

3. The ion accelerator of claim 1 wherein the anode is disposed between the annular collimating gas source and the solenoid.

4. The ion accelerator of claim 1 wherein the annular nozzle is a directional annular convergent-divergent type nozzle assembly.

5. The ion accelerator of claim 1 further comprising at least one collimating throat disposed between the annular nozzle and the solenoid.

6. The ion accelerator of claim 1 further comprising at least one intermediate electrode disposed between the anode and the solenoid.

7. The ion accelerator of claim 1 further comprising at least one intermediate radial magnetic field structure between the anode and the solenoid.

8. The ion accelerator of claim 1 wherein the anode element is composed of a pair of electrodes such that the neutral gas sheath passes between the two electrodes, an electrical bias applied between said electrodes, said electrodes connected by Hall effect magnetic field limes in such a manner as to allow the bias to direct Hall effect electrons onto the anode electrodes.

9. The ion accelerator of claim 1 wherein a fringe magnetic field is present generally within a vacuum gap composed of magnetic material forming the proximal end of the solenoid.

10. The ion accelerator of claim 1 wherein a mirror magnetic field is present generally at the distal end of the solenoid.

11. An ion accelerator comprising:

an annular collimating gas source;

an anode;

a solenoid for producing a magnetic field and having a proximal entrance end, the proximal entrance end having a fringe magnetic field; and a distal exit end having a fringe magnetic field; and one or more cathode electron source(s) positioned beyond the distal exit end of the solenoid magnetic field;

the annular collimating gas source adapted for directing gas axially into the entrance fringe radial magnetic field in conjunction with the anode and cathode producing an annular ion beam; and the ion beam being accelerated by an electric field between the anode and the cathode out of the solenoid through the exit fringe field; and the ion beam being space charge neutralized by the cathode electron source.

12. The ion accelerator of claim 11 wherein the anode is associated with the annular collimating gas source.

13. The ion accelerator of claim 11 wherein the anode is disposed between the annular collimating gas source and the solenoid.

14. The ion accelerator of claim 11 wherein the annular nozzle is a directional annular convergent-divergent type nozzle assembly.

15. The ion accelerator of claim 11 further comprising at least one collimating throat disposed between the annular nozzle and the solenoid.

16. The ion accelerator of claim 11 further comprising at least one intermediate electrode disposed between the anode and the solenoid.

17. The ion accelerator of claim 11 further comprising at least one intermediate radial magnetic field structure between the anode and the solenoid.

18. The ion accelerator of claim 11 wherein an anode element is composed of a pair of electrodes such that the neutral gas sheath passes between the two electrodes, an electrical bias applied between said electrodes, said electrodes connected by Hall effect magnetic field lines in such a manner as to allow the bias to direct Hall effect electrons onto the anode element.

19. The ion accelerator of claim 11 wherein a fringe magnetic field is present generally within a vacuum gap composed of magnetic material forming the distal end of the solenoid.

20. An ion accelerator comprising:

means for producing an annular gas sheath;

means for substantially eliminating any radial momentum from the annular gas sheath;

and means for ionizing and accelerating the annular gas sheath through a proximal end fringe of a solenoid magnetic field.

21. A method for producing an ion beam having a substantially reduced radially divergent component, the method comprising the steps of:

providing gas to an annular type nozzle;

producing an ionized annular gas sheath having minimal radial and azimuthal momentum from an anode operating in conjunction with a virtual cathode closed drift Hall accelerator in an axial fringe magnetic field;

accelerating the ionized annular gas sheath into a solenoid magnetic field;

producing ion orbits having minimal canonical angular momentum within the solenoid magnetic field; and producing a neutralized ion beam of high current with minimal beam divergence, exiting the distal fringe field.

22. A method for producing a stored ion beam having substantially zero canonical angular momentum, the method comprising the steps of:

providing gas to an annular type nozzle;

producing an ionized annular gas sheath having minimal radial and azimuthal momentum from an anode operating in conjunction with a virtual cathode closed drift Hall electrons in a proximal fringe magnetic field; and accelerating the ionized annular gas sheath into a solenoid magnetic field.

23. An ion accelerator comprising;

an annular collimating gas source, for receiving a gas and forming the gas into a gas sheath having minimal radial momentum;

an anode substantially separate from the gas source;

a virtual cathode comprised of closed drift hall electrons;

The anode and virtual cathode operable such that the gas sheath is ionized in the general vicinity of the anode;

a magnetic field structure having a proximal and a distal end;

the ionized gas sheath entering the proximal end of the magnetic field structure and the ions being accelerated into the magnetic field structure and the resulting ion orbits having minimal canonical angular momentum within the magnetic field structure; and the ions exiting the distal end of the magnetic field structure and being space charge and current neutralized in the general vicinity of the cathode electron source.

24. An ion accelerator comprising;

an annular collimating gas source, for receiving a gas and forming the gas into a gas sheath having minimal non-axial momentum;

an anode;

a virtual cathode closed drift Hall electrons;

the anode and virtual cathode operable such that the gas sheath is ionized in the general vicinity of the virtual cathode;

a magnetic field structure having a proximal and a distal end; and the ionized gas sheath entering the proximal end of the magnetic field structure and the ions being accelerated into the magnetic field structure; and the ions reflecting from the distal magnetic mirror field structure and being space charge neutralized in the general volume of the solenoid, by the cathode electron source.

25. An ion device comprising;

an annular collimating gas source;

an anode;

a solenoid;

the annular collimating gas source directing a gas having a minimal radial momentum and a minimal azimuthal momentum, the anode operable with a cathode for producing an annular ion beam wherein the ion beam is accelerated in to the solenoid field.

* * * * *